US010159997B2

(12) United States Patent
Foster et al.

(10) Patent No.: US 10,159,997 B2
(45) Date of Patent: Dec. 25, 2018

(54) LOW COST TRIGGER SPRAYER

(75) Inventors: Donald D. Foster, St. Charles, MO (US); Philip L. Nelson, Wildwood, MO (US)

(73) Assignee: SILGAN DISPENSING SYSTEMS CORPORATION, Grandview, MO (US)

( * ) Notice: Subject to any disclaimer, the term of this patent is extended or adjusted under 35 U.S.C. 154(b) by 477 days.

(21) Appl. No.: 12/941,725

(22) Filed: Nov. 8, 2010

(65) Prior Publication Data

US 2011/0240681 A1 Oct. 6, 2011

Related U.S. Application Data

(60) Provisional application No. 61/283,115, filed on Nov. 30, 2009.

(51) Int. Cl.
*B05B 11/00* (2006.01)

(52) U.S. Cl.
CPC ..... *B05B 11/0008* (2013.01); *B05B 11/001* (2013.01); *B05B 11/3011* (2013.01); *B05B 11/3057* (2013.01); *B05B 11/3064* (2013.01)

(58) Field of Classification Search
CPC ..... B05B 11/0008; B05B 11/001; B05B 11/3011; B05B 11/3057; B05B 11/3064; B05B 11/007
USPC ..... 222/383.1, 340, 382, 372; 239/333
See application file for complete search history.

(56) References Cited

U.S. PATENT DOCUMENTS

| | | | | |
|---|---|---|---|---|
| 3,715,060 | A * | 2/1973 | Benson | 222/207 |
| 4,669,664 | A * | 6/1987 | Garneau | 239/333 |
| 4,819,835 | A | 4/1989 | Tasaki | |
| 5,332,128 | A | 7/1994 | Mass et al. | |
| 5,356,049 | A | 10/1994 | Harris et al. | |
| 5,425,482 | A * | 6/1995 | Foster et al. | 222/207 |
| 5,439,178 | A | 8/1995 | Peterson | |
| 5,509,608 | A | 4/1996 | Foster et al. | |
| 5,566,885 | A | 10/1996 | Foster et al. | |
| 5,615,835 | A | 4/1997 | Nelson | |
| 5,636,768 | A | 6/1997 | Yamada | |
| 5,706,984 | A | 1/1998 | Tada et al. | |
| 5,738,251 | A | 4/1998 | Schuckmann | |
| 5,749,501 | A | 5/1998 | Maas et al. | |

(Continued)

FOREIGN PATENT DOCUMENTS

JP 11047650 A * 2/1999

*Primary Examiner* — Vishal Pancholi
(74) *Attorney, Agent, or Firm* — Barlow, Josephs & Holmes, Ltd.

(57) ABSTRACT

A trigger sprayer has a housing, a piston bore within the housing, and a piston reciprocally mounted within the piston bore. The housing further includes a flow passage through which liquid passes from a passage inlet to a passage outlet. An actuator is operable to reciprocate the piston within the piston bore between a vacuum stroke creating reduced pressure in the piston bore and a compression stroke creating increased pressure in the piston bore. A valve assembly within the flow passage controls the flow of liquid through the flow passage upon operation of the actuator. The valve assembly further comprises a check valve and a priming valve. The sprayer has a closure for mounting the sprayer to a container. The valve seat for the check valve is in a component formed separately from and operatively connected to the housing.

7 Claims, 8 Drawing Sheets

(56) References Cited

U.S. PATENT DOCUMENTS

| | | | | |
|---|---|---|---|---|
| 5,884,820 | A | 3/1999 | Thanisch et al. | |
| 5,906,301 | A | 5/1999 | Foster | |
| 6,116,472 | A | 9/2000 | Wanbaugh et al. | |
| 6,131,820 | A | 10/2000 | Dodd | |
| 6,234,412 | B1 | 5/2001 | von Schuckmann | |
| 6,641,003 | B1 | 11/2003 | Foster et al. | |
| 6,669,061 | B2 | 12/2003 | Tada | |
| 7,497,358 | B2 * | 3/2009 | Clynes et al. | 222/340 |
| 7,571,836 | B2 * | 8/2009 | Foster et al. | 222/340 |
| 7,712,636 | B2 * | 5/2010 | Foster et al. | 222/340 |
| 2007/0181606 | A1 * | 8/2007 | Foster | 222/383.1 |

* cited by examiner

LOW COST TRIGGER SPRAYER

RELATED APPLICATION DATA

This application claims priority to Application No. 61/283,115 filed on Nov. 30, 2009.

BACKGROUND

The invention pertains to trigger sprayers. More particularly, the invention pertains to a low cost trigger sprayer.

DETAILED DESCRIPTION

Figure 1:
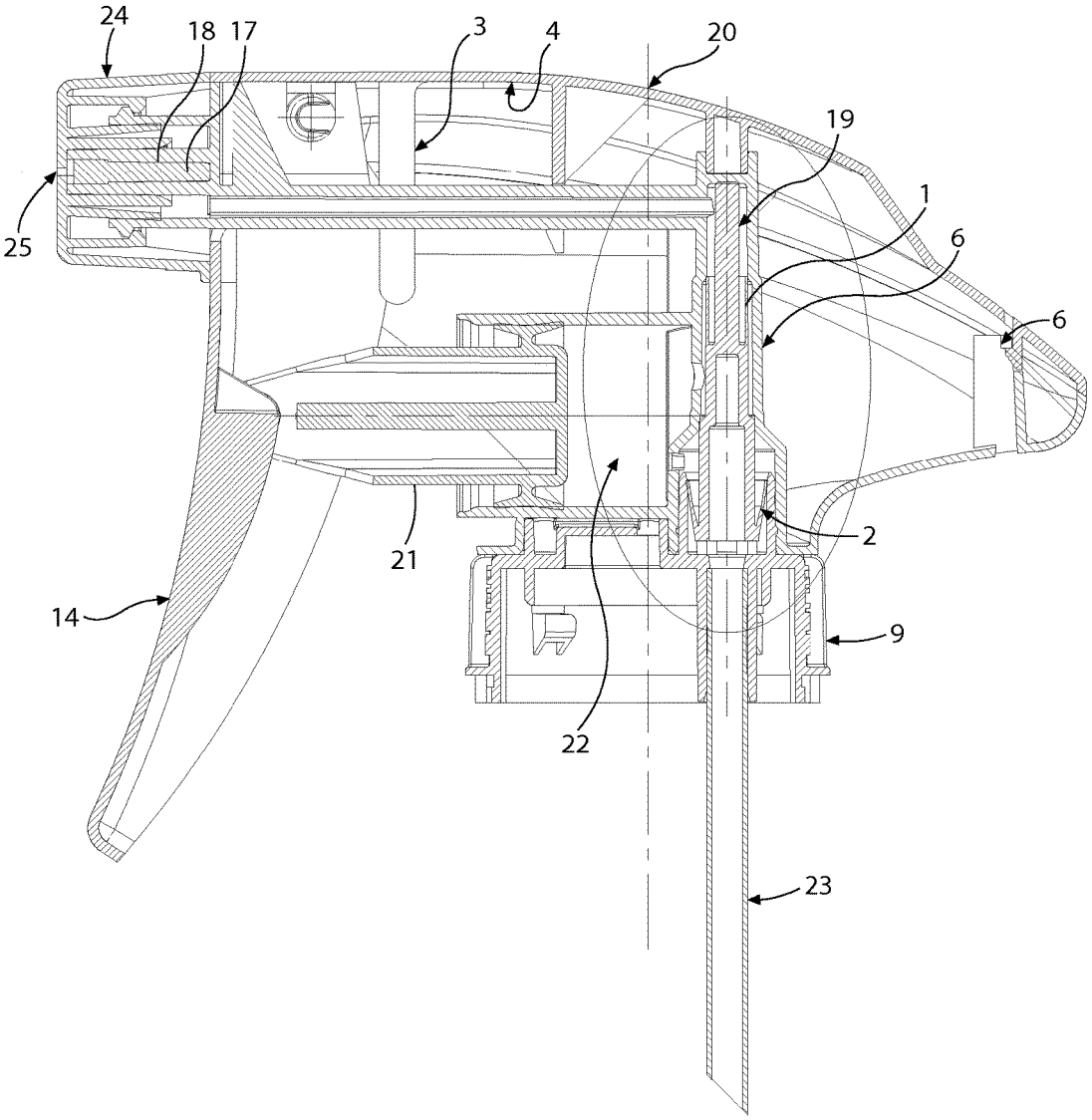
FIG. 1 is a side cross section of a trigger sprayer incorporating the present invention.
Figure 2:
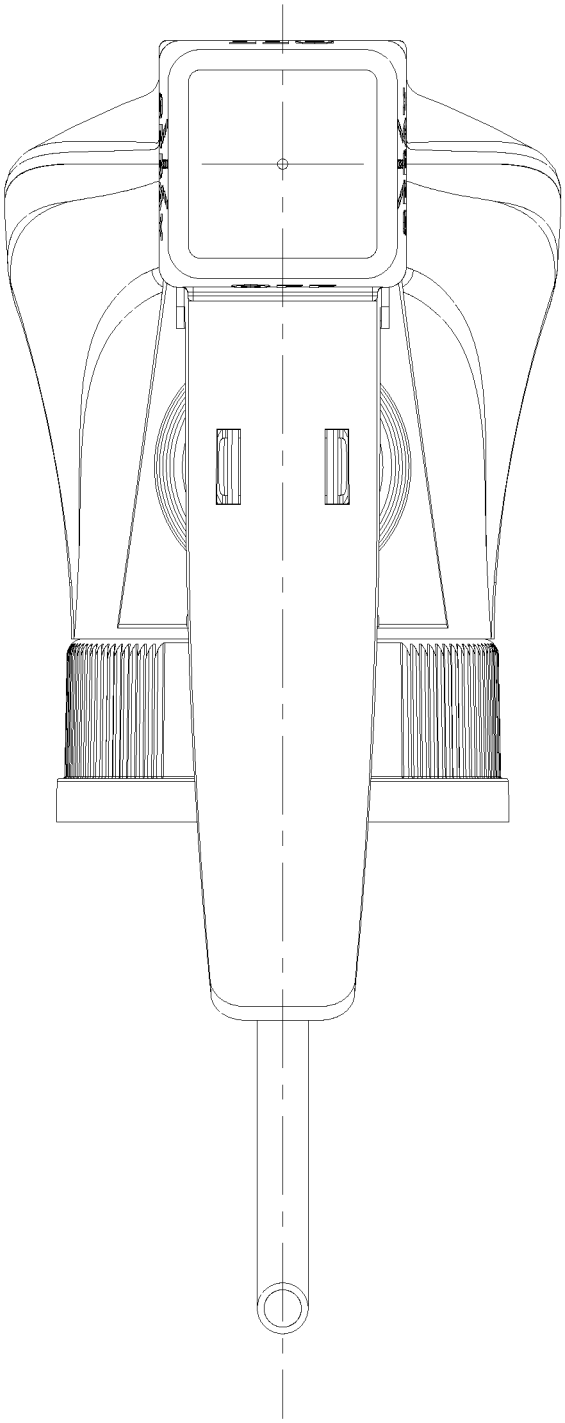
FIG. 2 is a front elevation of the trigger sprayer of FIG. 1.
Figure 3:
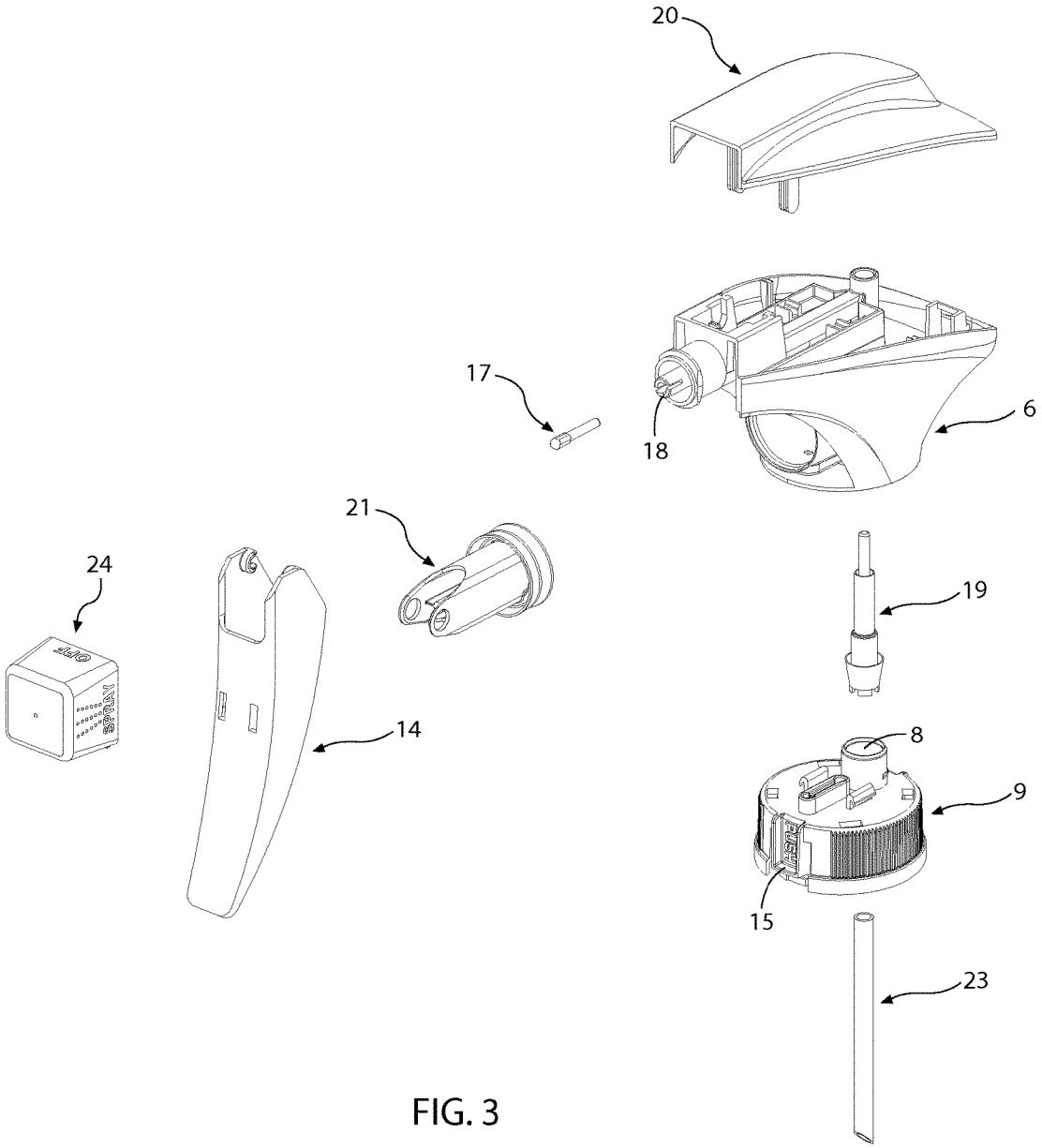
FIG. 3 is an exploded view of the trigger sprayer of FIG. 1.
Figure 4:
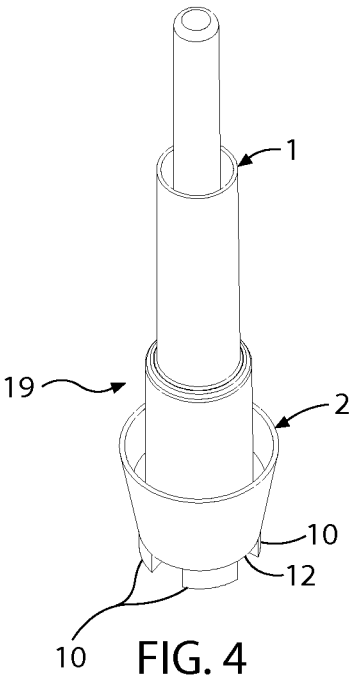
FIG. 4 is a perspective of the valve unit of the trigger sprayer of FIG. 1.
Figure 5:
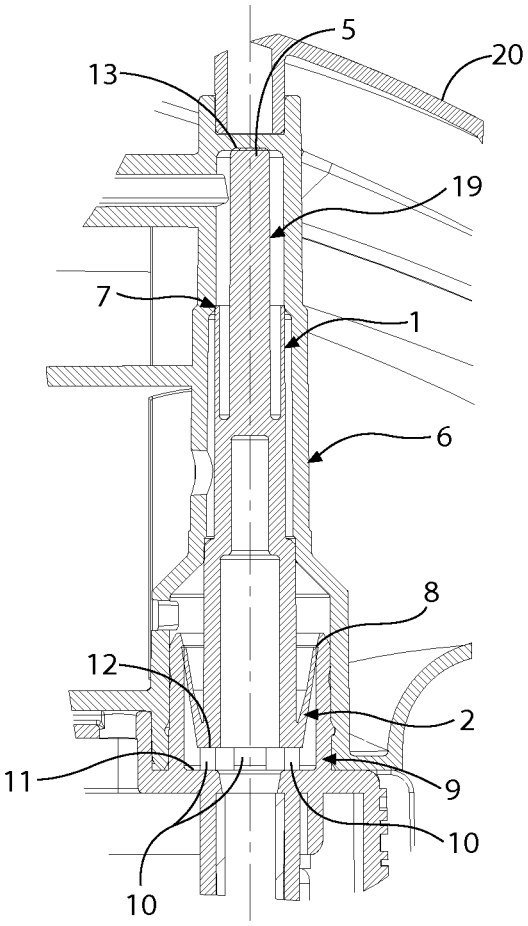
FIG. 5 is an enlarged cross section of the portion of FIG. 1 housing the valve unit.
Figure 6:
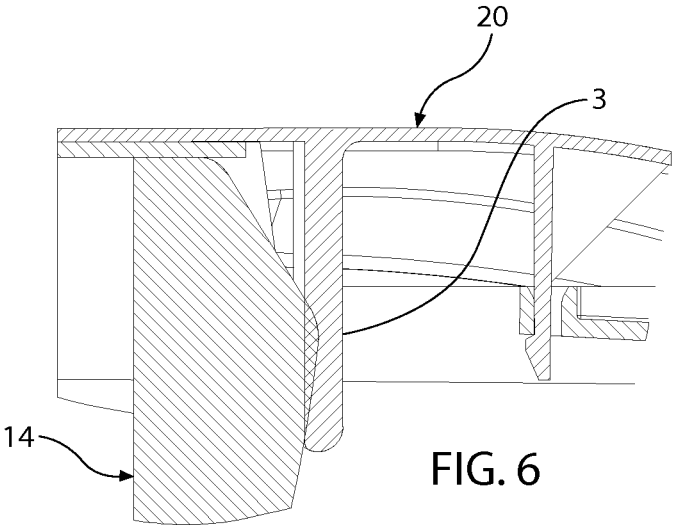
FIG. 6 is a cross section showing the area of engagement of the trigger and spring of the sprayer of FIG. 1.
Figure 7:
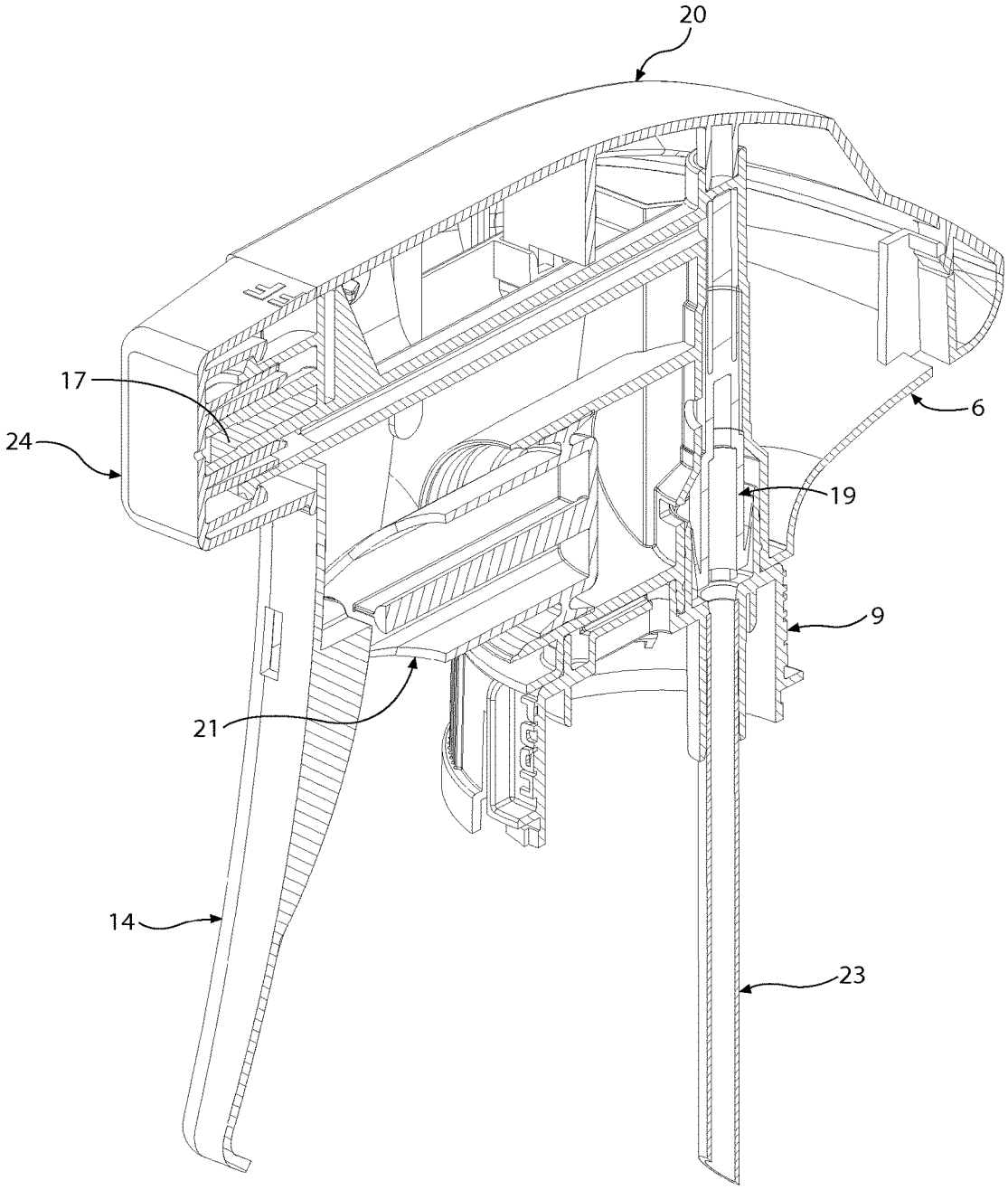
FIG. 7 is a view similar to FIG. 1 but shown in perspective.
Figure 8:
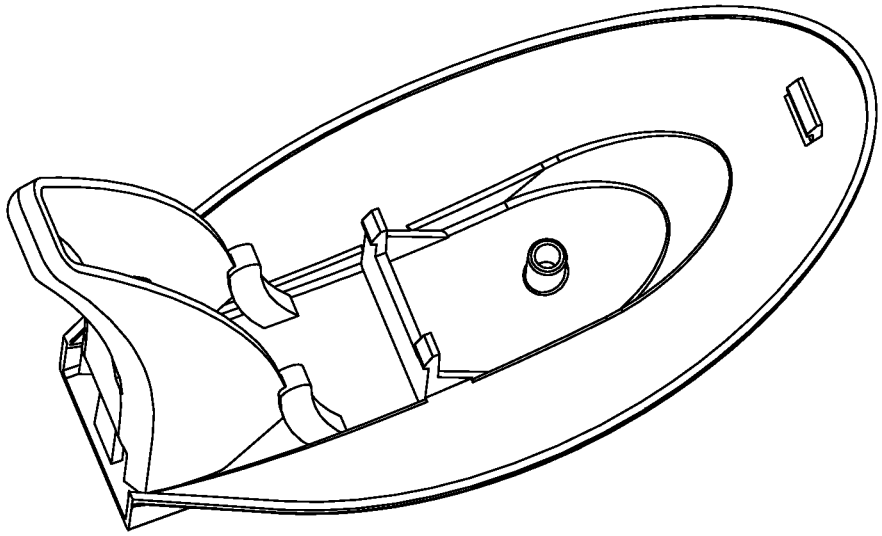
FIG. 8 is a bottom perspective of the trigger sprayer of FIG. 1.
Figure 9:
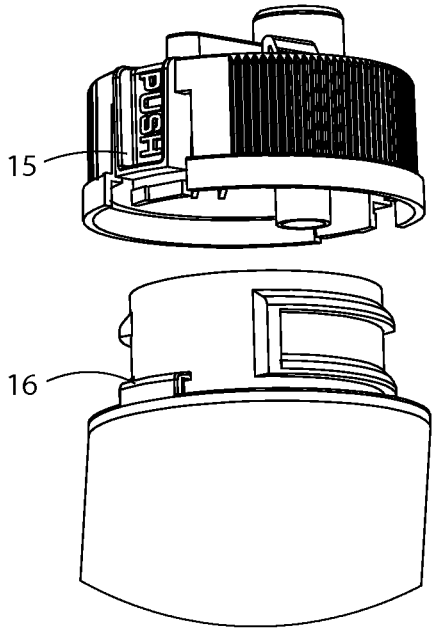
FIG. 9. is an exploded view of the closure and bottle neck configuration of an embodiment of the present invention.
Figure 10:
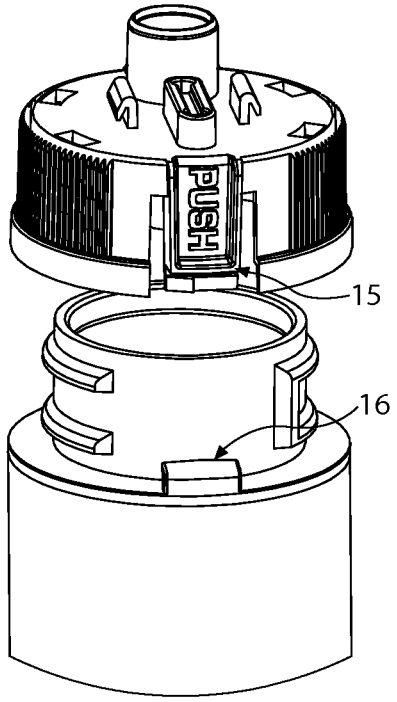
FIG. 10 is similar to FIG. 9 showing the closure and bottle neck in a different orientation.
Figure 11:
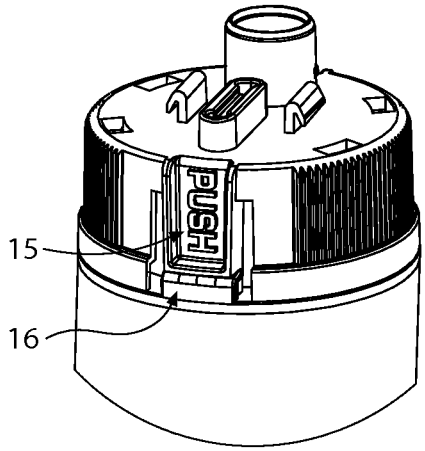
FIG. 11 shows the closure and bottle neck of FIGS. 9 and 10 as assembled.
Figure 12:
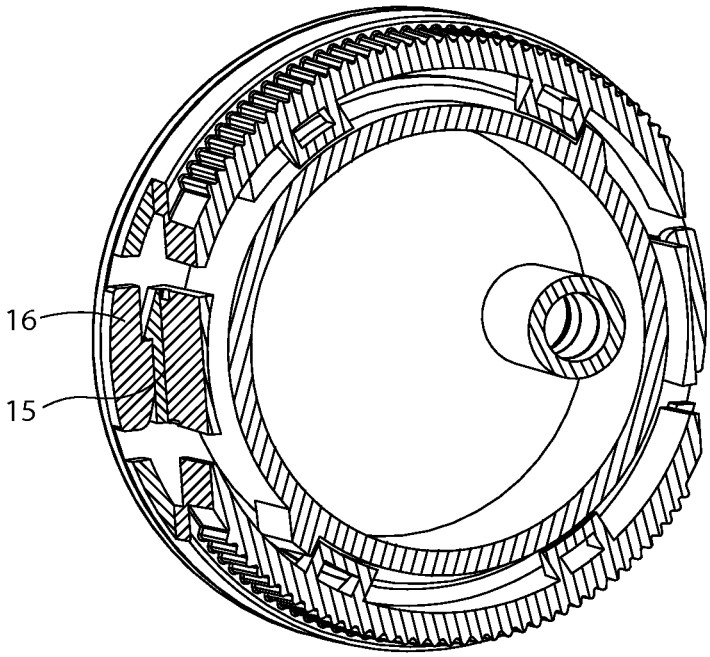
FIG. 12 is a bottom cross section of the closure and bottle neck of FIG. 11.

The low cost trigger sprayer shown in the drawing figures is made of all plastic materials and can be manufactured to dispense in a large range of outputs. This design can be used to dispense many liquid products from household chemicals, lawn and garden products, automotive products, etc. It is an open and closed opposing valve system using a one-piece piston 21 for compressing the liquid that is drawn into the piston bore area 22. The dip tube 23 is used to pull the liquid from the bottle into the piston chamber. Once the liquid is drawn into the piston chamber past the check valve area 2, the piston is pushed back into the bore by the actuator closing the check valve and opening the priming valve area 1 which forces the liquid into the nozzle 24 compressing the liquid again inside of the swirl chamber which now becomes a spray or foam depending on the type of configuration of the swirl chamber when the liquid is expelled through the nozzle orifice 25.

The low cost trigger sprayer shown in the drawing figures has a plastic return spring 3 which is molded or attached mechanically to the top of the internal surface 4 of the trigger sprayer housing cover component 20. When the plastic spring structure 3 is assembled into the housing 6, it provides a bias against the actuator 14 to force the return of the actuator to its at-rest position after each compression of the stroke.

The low cost trigger sprayer shown in the drawing figures includes a one-piece valve system 19 for priming and check functions. The top portion 1 of the valve 19 (priming function) is shaped in a straight diameter tube and the lower portion 2 of the valve 19 (check function) is shaped in a frusto-conical manner. The extreme top portion 5 of the one-piece valve system 19 provides a stop against the inside surface of the housing 6 which positions the one-piece valve system 19 in the correct relationship to the priming valve area 1 and mating valve seat area 7 in the housing component 6, as well as the check valve area 2 and mating valve seat area 8 in the bayonet component 9. Designing the priming valve seat area 7 in the housing 6 and the check valve seat area 8 in a separate component bayonet 9 is of great benefit for molding, assembly and improved quality performance which also reduces manufacturing cost. Ribs 10 on the lower portion of the one-piece valve system 19 provide clearance for product flow between surface 11 of the bayonet component 9 and surface 12 of the one-piece valve system 19 as well as keeping the top portion 5 of the one-piece valve system 19 in the correct position to surface 13 of the housing component 6.

The low cost trigger sprayer shown in the drawing figures includes a bayonet closure system 9 to secure the trigger sprayer to the bottle. The bayonet system 9 being a separate component and not part of the housing or any outside shroud component as in many other less efficient bayonet designs allows for changing the diameter of the closure system easily to accommodate different bottle neck sizes. Furthermore, the bayonet system 9 has a child resistant feature 15 (one, two or more). The child resistant feature 15 must be squeezed to allow disengagement from detail 16 on the bottle.

The low cost trigger sprayer shown in the drawing figures includes a swirl component 17 to provide mechanical break-up of the fluid for spraying or foaming and is designed as a simple easily manufactured component tubular in shape which allows for easy assembly into the housing component 6. The tubular shape also eliminates excess clearance inside of the area 18 of housing 6 providing an exceptional spray or foam delivery.

This low cost all plastic trigger sprayer is designed to use minimum plastic and components to reduce weight and manufacturing cost with high quality.

The function of the trigger sprayer is evident from the forgoing description. Upon pulling the trigger actuator 14 in the compressing stroke, the pressure in the piston bore 22 increases to close the check valve 2 thereby preventing the flow of liquid from the piston bore to the dip tube 23 and container, and to open the priming valve 1 to allow liquid in the piston bore to flow to the sprayer nozzle. Upon releasing the trigger actuator in the vacuum stroke, the priming valve 1 closes creating reduced pressure in the piston bore and opening the check valve 2 causing liquid from the container to flow through the dip tube 23 into the piston bore. Forming the check valve seat 8 in the closure 9 rather than in the sprayer housing 6 greatly facilitates assembly of the valve unit 19 with the sprayer housing. Assembly of the valve unit, closure, and housing can be accomplished with high speed automated equipment by either first inserting the valve unit, priming valve first, into the housing, and then assembling the closure and housing with the check valve positioned within the closure, or by preassembling the valve unit and closure with the check valve within the closure, and then inserting the valve unit, priming valve first, into the housing and assembling the closure to the housing. With either way of assembly there is no interference created between the check valve skirt and the wall of the housing that would cause the check valve to jamb upon its inserting into the housing.

It should be noted that while the closure 9 is shown to be of the bayonet type, alternatively the closure 9 may be of the treaded, screw-on, type as is well known in the art.

What is claimed is:

1. A sprayer comprising:

a housing, said housing having a piston bore, a piston reciprocally mounted within said piston bore, a flow passage within the housing for the passage of liquid from a passage inlet to a passage outlet, an actuator operable to reciprocate the piston within the piston bore between a vacuum stroke that is configured and adapted to create reduced pressure in the piston bore and a compression stroke that is configured and adapter to create increased pressure in the piston bore, a one-piece valve within the flow passage for controlling the flow of liquid through the flow passage upon operation of the actuator, said valve mounted generally vertically within the housing and further comprising a check valve at a lower portion thereof and a priming valve at an upper portion thereof, the check valve comprising a frusto-conical portion, and a component formed separately from and operatively connected to said housing and having a check valve seat in sealing engagement with the frusto-conical portion of the check valve during the compression stroke of the piston, said valve still further comprising spaced ribs extending from the lower portion thereof providing clearance for product flow between the lower surface of the valve and the bottom surface of the check valve seat, wherein the frusto-conical portion of the check valve is received entirely within the component, and wherein the priming valve has a generally straight skirt having an annular surface that mates with and engages an annular surface of a priming valve seat of the housing during the vacuum stroke of the piston.

2. The sprayer of claim 1 wherein the valve is of one-piece, plastic molded, construction.

3. The sprayer of claim 1 wherein the frusto-conical portion of the check valve has an annular surface that is configured and adapted to mate with and engage an annular surface of the check valve seat during the compression stroke of the piston.

4. The sprayer of claim 1 wherein the separately formed component is a bayonet closure configured and adapted to mount the sprayer to a container.

5. The sprayer of claim 1 wherein the separately formed component is a threaded, screw-on, type closure configured and adapted to mount the sprayer to a container.

6. The sprayer of claim 1, further comprising a dip tube substantially co-axially aligned with the valve.

7. The sprayer of claim 1, wherein the priming valve further includes a stop that extends upwards from, and above, the skirt configured to abut the housing.

* * * * *